US010299612B2

(12) United States Patent
Dean

(10) Patent No.: US 10,299,612 B2
(45) Date of Patent: May 28, 2019

(54) INTEGRAL LID HONEY DIPPER

(71) Applicant: Russ Dean, Advent, WV (US)

(72) Inventor: Russ Dean, Advent, WV (US)

( * ) Notice: Subject to any disclaimer, the term of this patent is extended or adjusted under 35 U.S.C. 154(b) by 18 days.

(21) Appl. No.: 15/187,332

(22) Filed: Jun. 20, 2016

(65) Prior Publication Data

US 2017/0007052 A1 Jan. 12, 2017

Related U.S. Application Data

(60) Provisional application No. 62/182,451, filed on Jun. 20, 2015.

(51) Int. Cl.
*A47G 21/00* (2006.01)
*B65D 51/32* (2006.01)

(52) U.S. Cl.
CPC ..... *A47G 21/00* (2013.01); *B65D 51/32* (2013.01)

(58) Field of Classification Search
CPC ..... A47G 21/00; B65D 51/32
USPC ..... 220/212; 215/276, 228
See application file for complete search history.

(56) References Cited

U.S. PATENT DOCUMENTS 1,779,018 A * 10/1930 Smallwood ..... B44D 3/121 206/15.3
1,834,085 A * 12/1931 Bloom ..... A47G 19/186 206/229
2,106,313 A * 1/1938 Amrine ..... A47G 19/186 220/735
2,149,698 A * 3/1939 Humphrey ..... B65D 51/246 141/112
5,251,774 A * 10/1993 Engle ..... A47G 19/186 215/228
5,586,676 A * 12/1996 Lynd ..... A47G 21/145 215/228
7,644,832 B1 * 1/2010 Tsengas ..... B65D 43/0208 220/212
8,550,268 B1 * 10/2013 Chisholm ..... B65D 45/305 215/274
2002/0000388 A1 * 1/2002 Frisk ..... B44D 3/123 206/15.3
2005/0218141 A1 * 10/2005 Kratzer ..... A47G 19/186 220/212
2007/0062904 A1 * 3/2007 Beaudette ..... A61J 9/00 215/276
2008/0217333 A1 * 9/2008 Mayo ..... A47G 19/186 220/212
2009/0277902 A1 * 11/2009 Darflinger ..... B65D 51/246 220/212

FOREIGN PATENT DOCUMENTS

CN 204489551 U * 7/2015

OTHER PUBLICATIONS

Wikipedia Commons. (Mar. 13, 2011). Photo of "Wooden honey dipper." Retrieved from: https://commons.wikimedia.org/wiki/File:Wooden_honey_dipper_(5536641494).jpg.*

(Continued)

*Primary Examiner* — James N Smalley
(74) *Attorney, Agent, or Firm* — Akerman LLP

(57) ABSTRACT

An article for extracting a viscous fluid from a vessel comprising a plurality of concentric annular ring portions; said ring portions connected in a stack with a series of grooves located in between them; said stack connected to a shaft; and an annular lid portion connected to said shaft.

4 Claims, 9 Drawing Sheets

(56) References Cited

OTHER PUBLICATIONS

Colourbox. (Apr. 10, 2013; shown in bottom left corner). Photo of "Honey dripping from a wooden honey dipper on white backround, stock photo." Retrieved from: https://www.colourbox.com/image/honey-dripping-from-a-wooden-honey-dipper-image-6513268.*

* cited by examiner

INTEGRAL LID HONEY DIPPER

PRIORITY

This application claims priority status from Provisional Application No. 62/182,451, filed on Jun. 20, 2015.

BACKGROUND

The invention relates to a honey dipper for extracting honey from a vessel, the honey dipper having an integral lid for securing the dipper within the opening of a vessel, such as a jar, and at the same time for sealing the jar from dirt, insects, and, to some extent, the atmosphere.

A honey dipper is a device that is used to extract viscous fluids (generally honey) from a vessel such as a jar or container, and then used to exude the fluid onto another surface. FIG. 1 shows a conventional honey dipper 1 with a shaft 2 and a series of concentric annular ring portions 4 in a stack that vary in size. The ring portions are separated by a series of coaxial grooves 6. The dipper is used by twirling or twisting upon dipping into the viscous fluid. The fluid is then entrained in the grooves during the twirling. The dipper is then used to drizzle the fluid, such as honey, on bread, biscuits, or other foods. It can be made of metal, plastic, or wood, depending on the user's preference, and can be one piece or made up of multiple pieces.

A problem with conventional honey dippers is that after use when left in an open fluid-containing jar, as they normally are after using, with the shaft of the dipper extending from the jar, the open jar attracts bugs such as ants, and dirt. The other option at this point is to wash the dipper after use and then seal the jar. Both situations result in a loss of the honey or other fluid, and much waste.

Therefore, it is a long felt but still unsatisfied need to create a honey dipper that is used to extract fluid and which prevents a waste of the honey (or other fluid).

Accordingly, it is an object of the present invention to provide a honey dipper with an integral lid for closing the top of a container.

Another object of the present invention is to provide a honey dipper with an integral lid for engaging with the lid of the fluid-carrying container.

A further object of the present invention is to provide a honey dipper with an integral lid combined with a container for holding honey.

Yet another object of the present invention is to provide a honey dipper with an integral lid and a container or lid with which the honey dipper engages.

These and other objects of the present invention will become more apparent to those skilled in the art after studying the following disclosure.

SUMMARY OF THE INVENTION

In accordance with one aspect of the present invention, an integral lid honey dipper includes: a tapered shaft ending in a series of concentric annular ring portions. The ring portion may be of the same size or varying sizes. The ring portions are separated by annular grooves along the shaft. The shaft at the other end is connected to a cylindrical lid member, which seals the top of a container containing a viscous fluid such as honey. The lid member terminates in a circular handle member, but the handle may be of any shape. The top of the lid member has an annular ridge whose top mates with the underside of an annular ring of a conventional mason jar lid. The underside of the annular ridge rests on the top edge of a mason jar. The lid is then screwed onto the top of the jar, with the honey dipper retained by the lid and suspended in the center of the jar, with the ridge trapped between the bottom surface of the annular ring and the top edge of the mason jar.

In accordance with another aspect of the present invention, an integral lid honey dipper includes: a tapered shaft ending in a series of concentric annular ring portions. The ring portions may be of the same size or varying sizes. The ring portions are separated by annular grooves along the shaft. The shaft at the other end is connected to a cylindrical lid member, which seals the top of a container containing a viscous fluid such as honey. The lid member terminates in a circular handle member, but the handle may be of any shape. The honey dipper of this embodiment can be used with any container.

Other aspects of the present invention will become apparent to those skilled in the art upon studying these disclosures.

DESCRIPTION OF THE PREFERRED EMBODIMENT

To further illustrate the present invention, the construction and operation of the preferred embodiment will be described. The description of the preferred embodiment is provided merely to further illustrate the present invention and is not intended to limit the scope of the invention in any fashion.

Figure 1:
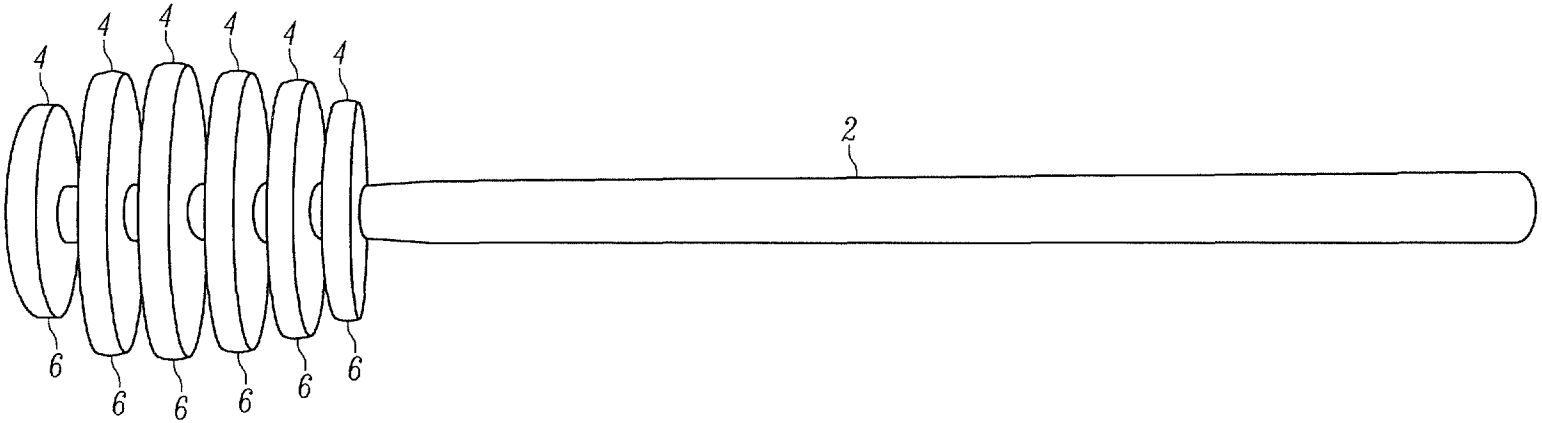
PRIOR ART FIG. 1
FIG. 1 is a perspective view of conventional honey dipper 1.

FIG. 1 shows a perspective view of a prior art honey dipper 1, which may be made of wood, metal, or plastic. Shaft 2 terminates in several annular disc members 4, which as shown progress in size to the middle of the stack, then decrease in size. The discs may be of uniform size as well or any suitable mixture of sizes. The discs create a series of annular grooves 6 for entraining honey upon inserting the disc-end of the dipper into the viscous fluid and spinning or twirling it. Upon spinning, honey is entrained in the grooves, at which time the honey dipper is removed from the fluid, and the fluid is spread or drizzled onto another surface such as bread or toast.

Conventionally, the honey dipper 1 is then placed back in the container that contains the honey, in which case the shaft extends through the top of the jar, preventing the jar from sealing and allowing access to dirt and insects to the honey, as allowing air to freely access the honey, accelerating its crystallization. Alternatively, the dipper is taken out and the jar is sealed. The dipper is then washed, with a large amount of honey being washed down the drain and wasted. Much honey or other fluid is wasted by using conventional dippers for these reasons. The present invention solves these and other problems associated with honey dippers.

Figure 2:
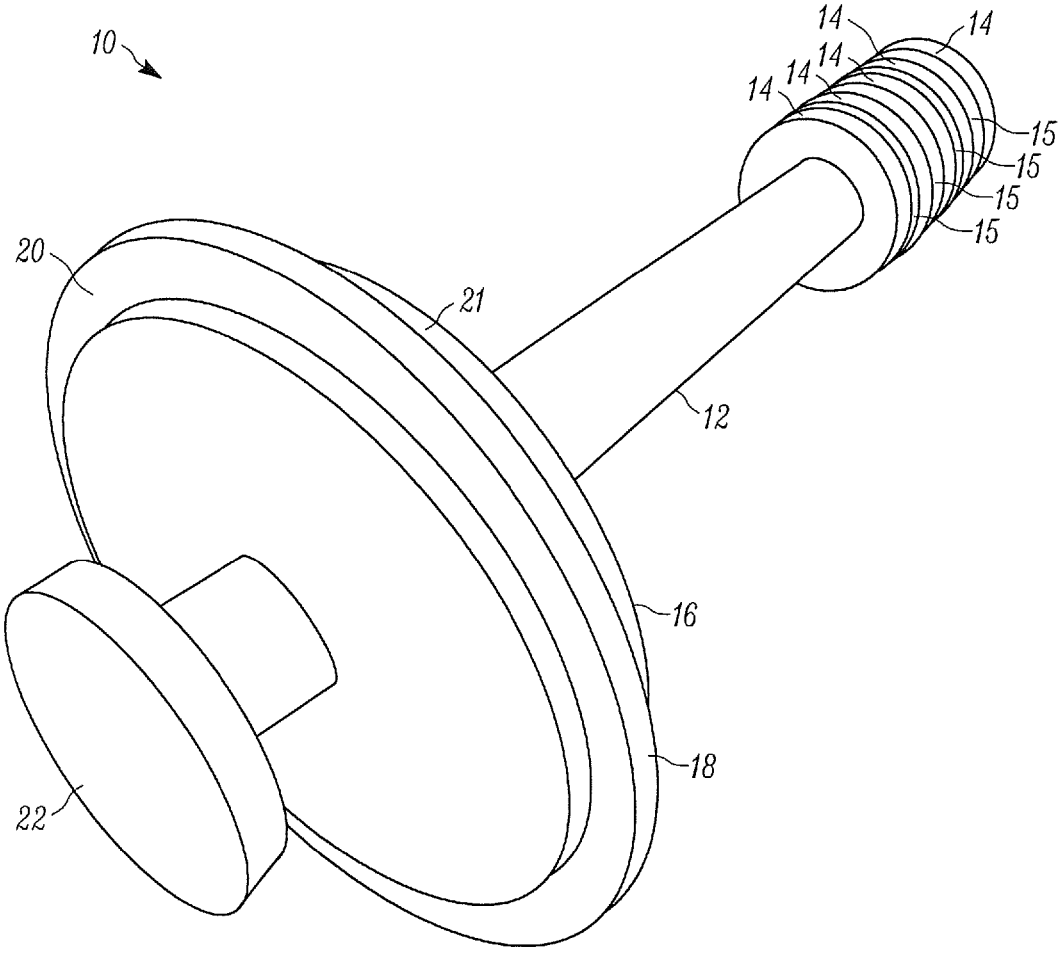
FIG. 2 is a perspective view of the integral honey dipper 10 of the present invention.

FIG. 2 shows a perspective view of the integral lid honey dipper 10 of the present invention. Tapered shaft 12 culminates in disc members 14 separated by grooves 15. Tapered shaft 12, which along with the rest of the preferably (although it may be multiple pieces) one piece integral lid honey dipper 10 is preferably made of wood such as apple or maple, impregnated with beeswax, but may be made of any suitable material such as other woods, plastic or metal, terminates in the underside of lid member 16. Lid member 16 has annular ridge 18 which forms first annular recess 20 and second annular recess 21. First annular recess 20 engages with the annular ring 24 of the lid of a vessel 34, as shown and described below Second annular recess 21 rests on the upper edge of the opening 32 of vessel 34. The lid member 16 terminates in a circular handle member 22, but the handle may be of any shape.

Figure 3:
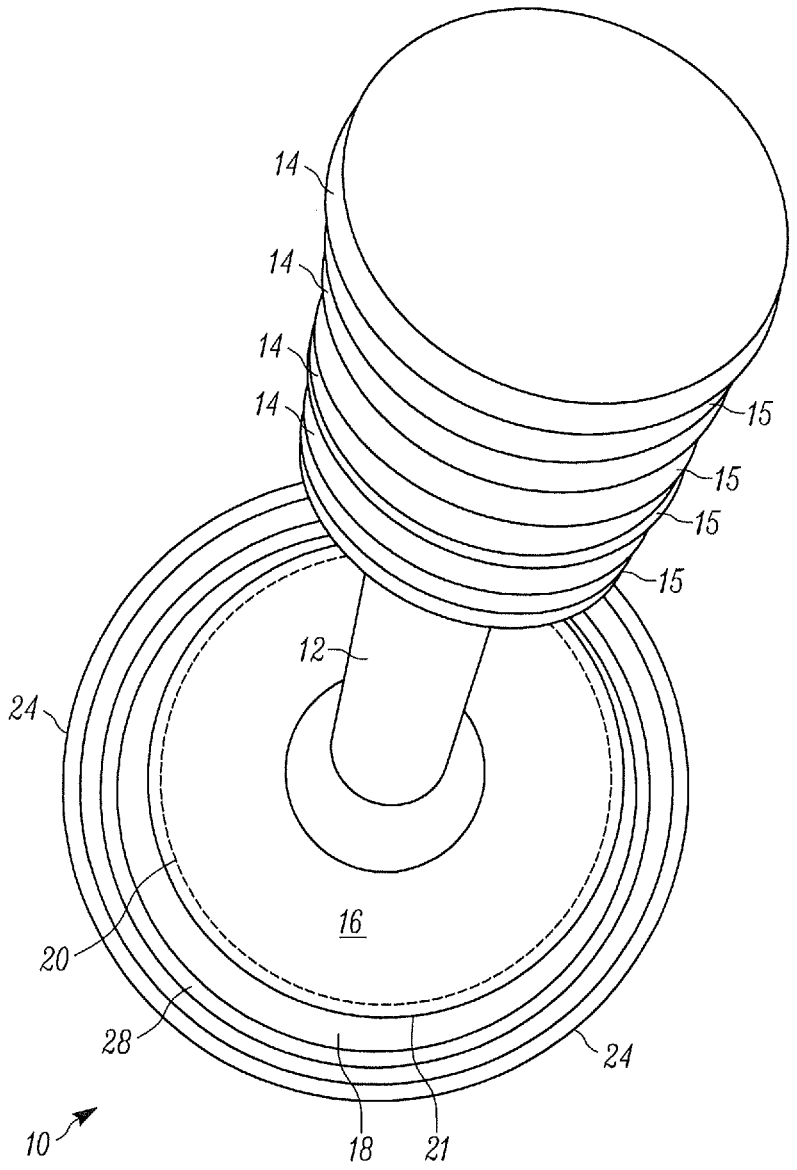
FIG. 3 is a perspective view of the integral honey dipper 10 of the present invention shown from beneath the structure.

FIG. 3 shows a bottom perspective view of integral lid honey dipper 10, looking from below. In this view, the integral lid honey dipper 10 is installed in the annular ring 24. Annular ridge 18 engages the underside of annular ring 24 to secure it in place, with the first annular recess 20 resting against the lower surface 28 of annular ring 24. The annular ring 24 is then screwed down onto the threads of a vessel 34, such as a mason jar.

Figure 4:
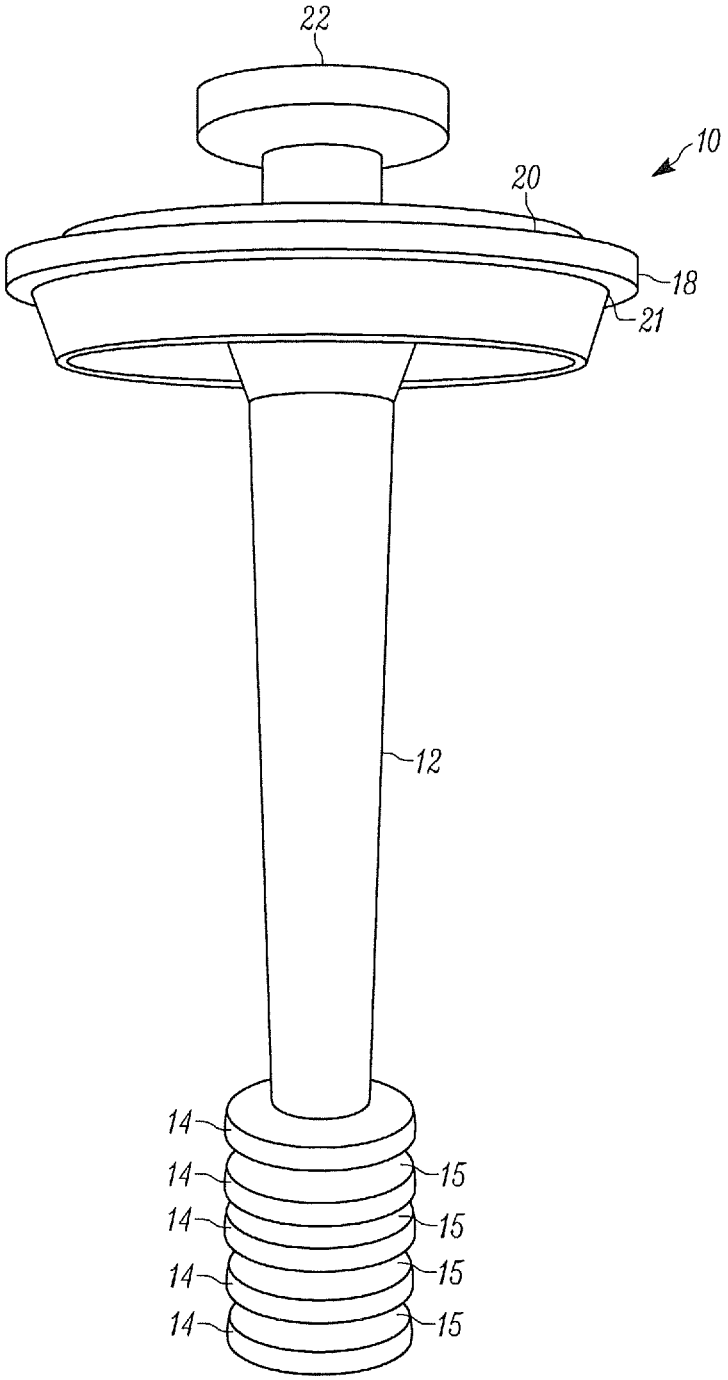
FIG. 4 is a perspective view of the integral lid honey dipper 10 of the present invention shown from the side.

FIG. 4 shows a side perspective view of integral lid honey dipper 10. As can be seen, annular ridge 18 forms first annular recess 20 and second annular recess 21, which cause the annular ridge 18 to be caught between the lower surface 28 of the annular ring 24 (not shown) and the upper edge of the opening 32 of vessel 34 (not shown).

Figure 5:
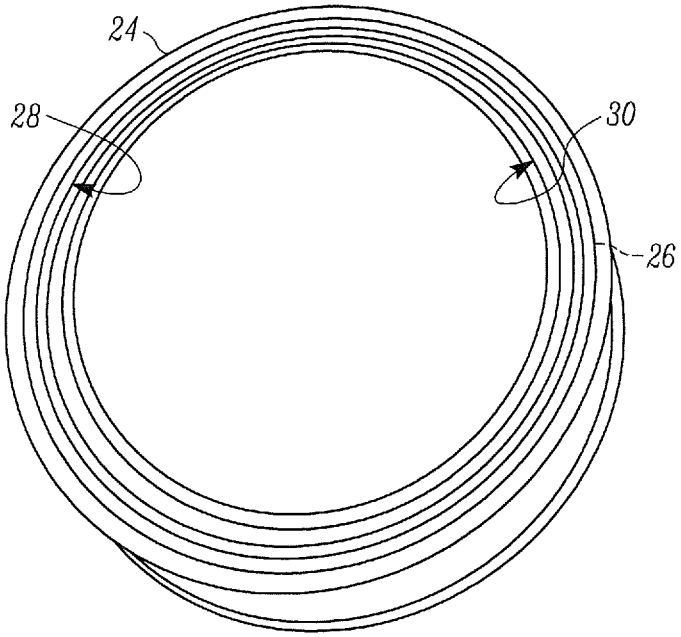
FIG. 5 is a top perspective view of the annular ring 24 used with the integral lid honey dipper 10 of the present invention.

FIG. 5 shows a top perspective view of the annular ring 24. Annular ring 24 has a top surface 26 and an lower surface 28. Lower surface 28 engages the annular ridge 18 of the honey dipper at first annular recess 20 (not shown). Annular ring 24 also has a series of threads 30 which screw down onto the opening of a vessel 34 (not shown).

In operation integral lid honey dipper 10 is inserted from below into the annular ring 24 such that annular ridge 18 at recess 20 is placed into engaging contact with lower surface 28 of the annular ring 24. The annular ring 24 is then screwed onto the threads of vessel 34. The annular ridge 18 is held in frictional engagement between the lower surface 28 of the annular ring 24 and the upper edge of the opening 32 of vessel 34 by virtue of the engagement of the threads 30 of the annular ring 24 with the corresponding threads of vessel 34. The annular ridge 18 is trapped between lower surface 28 of annular ring 24 at first annular recess 20 and the upper edge of opening 32 of the vessel 34 at second annular recess 21.

Figure 6:
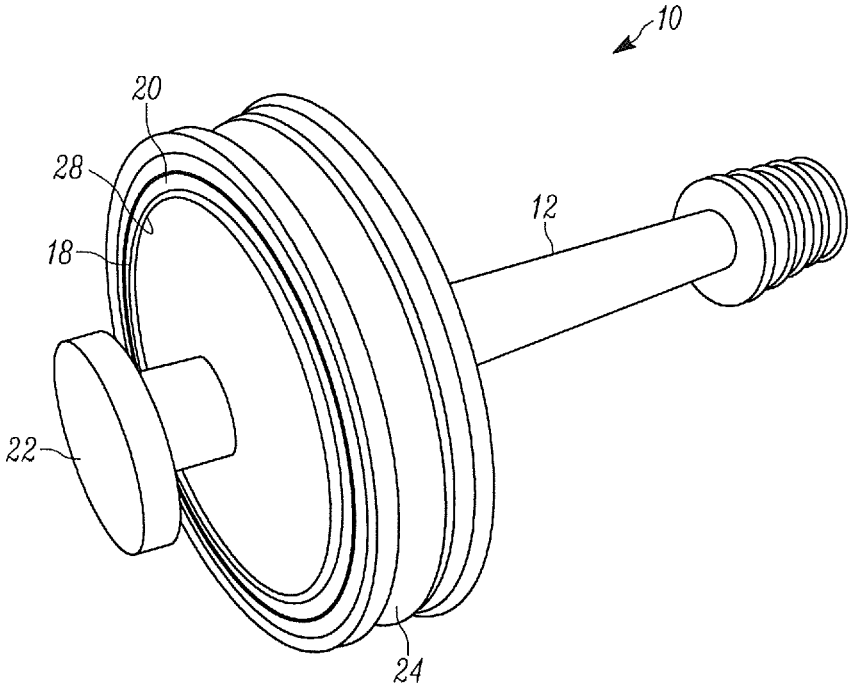
FIG. 6 is a perspective view of the integral lid honey dripper 10 of the present invention installed in the annular ring 24.

FIG. 6 shows a side perspective view of the integral lid honey dipper 10 of the present invention inserted into the annular ring 24. As can be seen, ridge 18 is engaged at first annular recess 20 under lower surface 28 of annular ring 24. The integral lid honey dipper 10 is inserted from the right into the annular ring 24, effectuating such engagement. The assembled dipper/ring is then screwed onto the top of a vessel 34 (not shown) such as a mason jar, with second annular recess 21 resting on the upper edge of the opening 32 of vessel 34.

Figure 7:
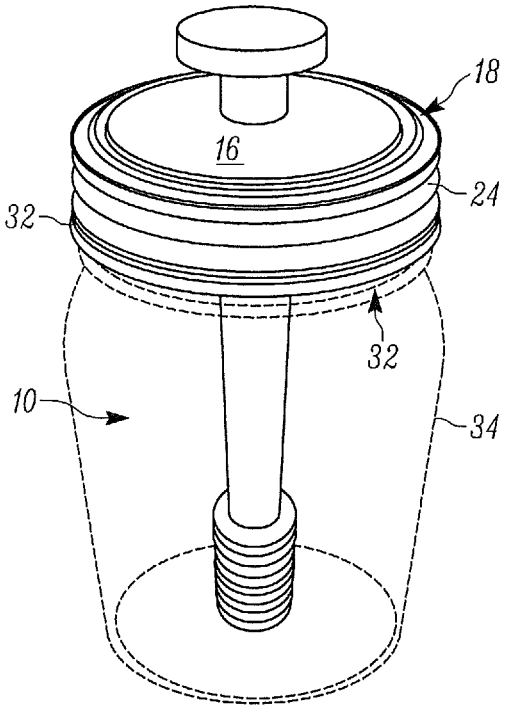
FIG. 7 is a perspective view of the integral lid honey dipper 10 of the present invention installed within a vessel 34.

FIG. 7 illustrates the integral lid honey dipper 10 of the present invention installed in vessel 34, such as a conventional mason jar. As can be seen, annular ring 24 is screwed down onto the opening 32 of vessel 30. Annular ridge 18 of honey dipper 10 is trapped at its top surface at recess 20 by the lower surface 28 of annular ring 24. Annular ridge 18 is trapped at its bottom surface at second recess 21 by the upper edge of the opening 32 of vessel 34 by virtue of the engagement of the threads 30 of annular ring 24 with the threads of the fluid between uses, with the vessel 34 sealed off from dirt, insects, and the environment, albeit without an airtight seal.

Figure 8:
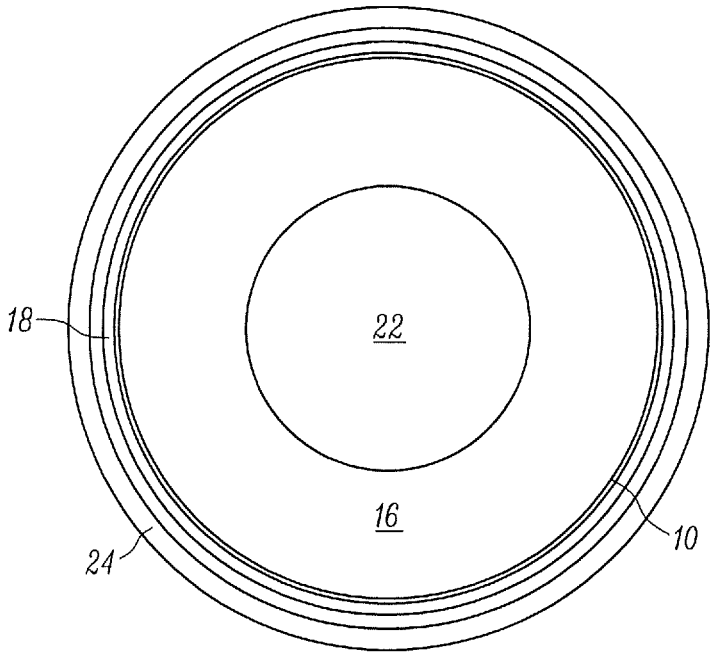
FIG. 8 is a top perspective view of the integral lid honey dipper 10 installed within the annular ring 24.

FIG. 8 illustrates a top view of the installed integral lid honey dipper 10. Annular ring 24 is in screwed-down engagement with ridge 18.

Figure 9:
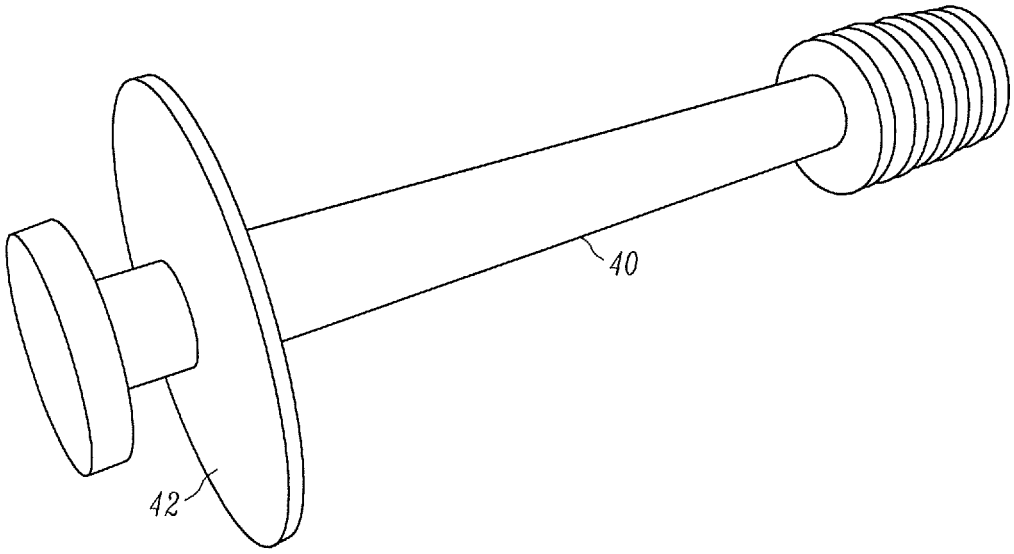
FIG. 9 is a perspective view of a second embodiment honey dipper 40 of the present invention.

FIG. 9 shows a perspective view from the side of a second embodiment of the present invention. Honey dipper 40 functions in much the same way as the first embodiment, with the exception of the integral lid 42, which is flat and simply rests on the top edge of the vessel into which the honey dipper is inserted, as opposed to being engaged by the lid.

I claim:

1. An apparatus for extracting a viscous fluid, said apparatus comprising:

a shaft comprising a first end and a second end;

a lid comprising a concentric first disc;

a second disc; and a first conical frustum having a first end and a second end, said second end of said first conical frustum having a diameter greater than the diameter of said first end of said first conical frustum;

said first disc situated above said second disc, said second disc having a diameter greater than the diameter of said first disc, such that said second disc, forms a first annular recess with said first disc;

said second disc situated above said second end of said first conical frustum, said second disc having a diameter greater than the diameter of said second end of said first conical frustum, such that said second disc forms a second annular recess with said second cud of said first conical frustum;

a handle connected to said first disc;

a second conical frustum having a first end and a second end, said second end of said second conical frustum having a diameter greater than the diameter of said first end of said second conical frustum;

said first end of said second conical frustum connected to said second end of said shaft;

said second end of said second conical frustum connected to said first end of said first conical frustum;

a stack comprising a plurality of concentric discs and a series of grooves located in between said discs, said stack connected to said first end of said shaft;

said stack, said shaft, said second conical frustum, said lid, and said handle being made of a rigid material and being monolithic;

a vessel, said vessel comprising an opening;

said opening of said vessel further comprising an edge such that when said lid is placed over said opening, said edge engages said second annular recess of said lid and supports said lid:

an annular ring for partially enclosing said opening of said vessel;

said annular ring being removably attached to said opening of said vessel;

said annular ring comprising an inner rim;

said inner rim of said annular ring comprising a top surface and a bottom surface; and said lid being insertable into said annular ring such that when said lid is placed on said opening of said vessel and said annular ring is removably attached to said opening of said vessel, said first annular recess of said lid engages said bottom surface of said inner rim of said annular ring, and said second annular recess of said lid engages said edge of opening of said vessel, forming a seal and suspending said honey dipper in said vessel.

2. The apparatus of claim 1, wherein said rigid material is selected from the group consisting of wood, metal, and rigid plastic.

3. The apparatus of claim 1, wherein said plurality of concentric discs are of the same size.

4. The apparatus of claim 1, wherein said plurality of concentric discs are of varying sizes.

* * * * *